US008550868B2

(12) United States Patent
Kwak et al.

(10) Patent No.: US 8,550,868 B2
(45) Date of Patent: Oct. 8, 2013

(54) TUBE CONNECTOR FOR ASSEMBLY TOY

(76) Inventors: Dae-keun Kwak, Daejeon (KR); Byoung-kon Kwak, Daejeon (KR)

( * ) Notice: Subject to any disclaimer, the term of this patent is extended or adjusted under 35 U.S.C. 154(b) by 0 days.

(21) Appl. No.: 13/433,860

(22) Filed: Mar. 29, 2012

(65) Prior Publication Data

US 2012/0184174 A1 Jul. 19, 2012

Related U.S. Application Data

(63) Continuation-in-part of application No. 12/632,978, filed on Dec. 8, 2009, now abandoned, which is a continuation-in-part of application No. PCT/KR2008/003200, filed on Jun. 9, 2008.

(30) Foreign Application Priority Data

Jun. 9, 2007 (KR) ..... 10-2007-0056380

(51) Int. Cl.
*A63H 33/08* (2006.01)

(52) U.S. Cl.
USPC ..... 446/124

(58) Field of Classification Search
USPC ..... 446/124
See application file for complete search history.

(56) References Cited

U.S. PATENT DOCUMENTS

| | | | | | |
|---|---|---|---|---|---|
| 1,678,709 | A | * | 7/1928 | Schurmann | 464/150 |
| 4,109,398 | A | * | 8/1978 | Hida | 434/370 |
| 4,348,830 | A | * | 9/1982 | Hagberg | 446/126 |
| 4,430,826 | A | * | 2/1984 | Ryaa | 446/124 |
| 4,906,122 | A | * | 3/1990 | Barrett et al. | 403/305 |
| 5,451,177 | A | | 9/1995 | Gilman | |
| 5,582,488 | A | * | 12/1996 | Dudley et al. | 403/103 |

FOREIGN PATENT DOCUMENTS

EP 1679106 A1 7/2006

OTHER PUBLICATIONS

International Search Report mailed on Dec. 2, 2008 in International Application No. PCT/KR2008/003200.

* cited by examiner

*Primary Examiner* — Michael Dennis
(74) *Attorney, Agent, or Firm* — Novick, Kim & Lee, PLLC; Jae Youn Kim

(57) ABSTRACT

Disclosed is a tube connector for an assembly toy, which includes a cylindrical body having upper and lower horizontal surfaces, a circular hole perforated through the center of the body perpendicular to the horizontal surfaces for insertion of a tube, and at least one coupling rib integrally formed around the body at the level of one of the horizontal surfaces. As a tube is coupled to the coupling rib, assembly of various shapes of three-dimensional toys is possible.

14 Claims, 11 Drawing Sheets

TUBE CONNECTOR FOR ASSEMBLY TOY

CROSS REFERENCE TO RELATED APPLICATIONS

This application is a continuation-in-part of U.S. patent application Ser. No. 12/632,978, filed on Dec. 8, 2009, which is a continuation-in-part of PCT International Patent Application No. PCT/KR2008/003200, filed on Jun. 9, 2008 (and published in English as International Publication No. WO 2008/153292 on Dec. 18, 2008), which claims priority to Korean Patent Application No. 10-2007-0056380, filed on Jun. 9, 2007.

BACKGROUND OF THE INVENTION

1. Field of the Invention

The present invention relates to a tube connector for an assembly toy, and more particularly, to a tube connector for an assembly toy, which includes a semispherical or cylindrical body having horizontal surfaces defined at opposite end surfaces thereof, a hole perforated through the center of the body perpendicular to the horizontal surfaces, and at least one coupling rib integrally formed around the body at the level of any one of the horizontal surfaces, wherein a portion of the coupling rib corresponding to half the thickness of the coupling rib protrudes outward from the horizontal plane provided with the coupling rib, and the coupling rib takes the form of a bar and is configured to allow a tube to be inserted thereon.

In addition, the present invention relates to a tube connector for an assembly toy, which includes a semispherical body having a horizontal bottom surface, a hole perforated in the center of the semispherical body perpendicular to the bottom surface, and at least one insertion groove and at least one coupling hole, wherein an insert of a coupling rib is fixedly inserted through the insertion groove or the coupling hole.

2. Description of the Related Art

In general, there are provided a variety of shapes of assembly toys taking the form of assembly blocks, tubes, magnets, and the like. In the case of assembly blocks, such as, for example, those under the trade name LEGO", each block has a coupling protrusion and a coupling recess, thus enabling assembly of plural blocks without separate connectors. However, an assembly toy consisting of tubes has a need for a connector for connecting and fixing tubes to each other.

Conventionally, a connector used for tube assembly has been formed with a plurality of coupling ribs, to which tubes are coupled. For easy coupling of a plurality of tubes, the coupling ribs of the conventional connector only have, e.g., a linear or cross-shaped arrangement providing a predetermined angular tube arrangement. Also, the coupling rib has a fixed shape and therefore, is usable at only a specific part corresponding to the shape of the coupling rib. Thus, an additional connector is necessary when it is desired to change a coupling angle between tubes. Although a method for adjusting a coupling angle between tubes by overlapping a plurality of the linear or cross-shaped connectors to diversify an angle defined by the coupling ribs has been used, this method unfavorably increases a thickness of a body of the connector. Furthermore, as the coupling ribs of the coupled connectors are located at different heights rather than being located on the same plane, it may be difficult for a user to assemble a desired three-dimensional toy.

SUMMARY OF THE INVENTION

Therefore, the present invention has been made in view of the above problems, and it is an object of the present invention to provide a tube connector for an assembly toy, which includes a semispherical or cylindrical body having horizontal surfaces defined at opposite end surfaces thereof, a circular hole perforated through the center of the body perpendicular to the horizontal surfaces, and a coupling rib integrally formed around the body at the level of any one of the horizontal surfaces, wherein a portion of the coupling rib corresponding to half the thickness of the coupling rib protrudes outward from the horizontal plane provided with the coupling rib, the coupling rib takes the form of a bar to allow a tube to be inserted thereon, and, when the tube connector is coupled with another tube connector such that the horizontal surfaces provided with the coupling ribs of the two tube connectors are alternately coupled and come into contact with each other, a center axis of the at least one coupling rib formed at each of the tube connectors is aligned with the horizontal surfaces of the two alternately coupled tube connectors, and wherein an end of the coupling rib is divided into two parts spaced apart from each other, to enable strong fixation of a tube by a restoration force thereof when the two spaced parts of the coupling rib are inserted into the tube, and the coupling rib extends in the same horizontal direction as the horizontal surface, or obliquely extends by a predetermined angle with respect to the horizontal surface.

It is another object of the present invention to provide a tube connector for an assembly toy, which includes a semispherical body having a horizontal bottom surface, a cylindrical peripheral wall portion extending upward from the bottom surface to a predetermined height, and a domed top portion extending upward from the cylindrical wall portion, wherein the body is centrally perforated with a hole perpendicular to the bottom surface through which a tube connector coupling member is inserted, the bottom surface and the domed top portion of the body are formed respectively with at least one insertion groove and at least one coupling hole, and when the tube connector is coupled with another tube connector such that the bottom surfaces come into contact with each other, the tube connectors are rotatable respectively based on the contact bottom surfaces, enabling various variations in the position of the coupling rib.

In accordance with an aspect of the present invention, the above and other objects can be accomplished by the provision of a tube connector for an assembly toy, including a semispherical or cylindrical body having horizontal surfaces defined at opposite end surfaces thereof, a circular hole perforated through the center of the body perpendicular to the horizontal surfaces, and a coupling rib integrally formed around the body at the level of any one of the horizontal surfaces, wherein a portion of the coupling rib corresponding to half the thickness of the coupling rib protrudes outward from the horizontal plane provided with the coupling rib, wherein the coupling rib takes the form of a bar to allow a tube to be inserted thereon, and wherein, when the tube connector is coupled with another tube connector such that the horizontal surfaces provided with the coupling ribs of the two tube connectors are alternately coupled and come into contact with each other, a center axis of the at least one coupling rib formed at each of the tube connectors is aligned with the horizontal surfaces of the two alternately coupled tube connectors. An end of the coupling rib may be divided into two parts spaced apart from each other, to enable strong fixation of a tube by a restoration force thereof when the two spaced parts of the coupling rib are inserted into the tube. Alternatively, the bar-shaped coupling rib may be formed on an outer periphery thereof with a raised portion for fixation of a tube inserted on the coupling rib. The coupling rib may extend in the same horizontal direction as the horizontal surface, or may obliquely extend by a predetermined angle with respect to the horizontal surface.

In accordance with another aspect of the present invention, there is provided a tube connector for an assembly toy, comprising a semispherical body having a horizontal bottom surface, a cylindrical wall portion extending upward perpendicular from the bottom surface, and a domed top portion extending upward from the cylindrical wall portion. The body may be centrally perforated with a circular or polygonal hole perpendicular to the bottom surface. The bottom surface of the body may be formed with at least one insertion groove to pass a center thereof, and the domed top portion of the body may be formed with a plurality of coupling holes. A tube connector insert of a tube connector coupling rib may be inserted into the insertion groove or the coupling hole. The coupling rib may be formed at one end thereof with the tube connector insert, and at the other end thereof with a tube insert. Each of the tube connector insert and the tube connector may be divided into two parts spaced apart from each other to be inserted into the insertion groove, the coupling hole, or a tube.

After the tube connector is coupled with another tube connector such that the bottom surfaces of the bodies of the two tube connectors come into contact with each other, a tube connector coupling member may be inserted through the holes of the bodies. The tube connector coupling member may be formed with a pair of holding protrusions with a predetermined interval such that the bodies of the two tube connectors are fixed between the holding protrusions. Each of ends of the tube connector coupling member may be divided into two parts spaced apart from each other, allowing tubes to be connected respectively to the ends of the tube connector coupling member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a tube connector for an assembly toy according to exemplary embodiments of the present invention will be described in detail with reference to the accompanying drawings.

Figure 1:
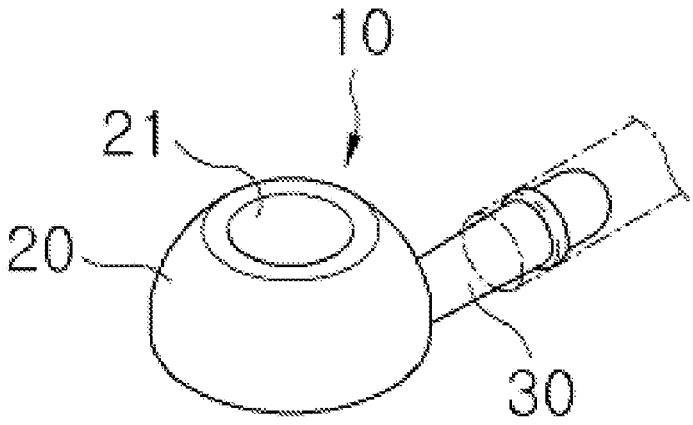
FIGS. 1~4 illustrates a tube connector for an assembly toy according to a first embodiment of the present invention, FIG. 1 being a perspective view of the tube connector according to the first embodiment, FIG. 2 being a front view of FIG. 1, FIG. 3 being a perspective view illustrating a coupled state of two tube connectors of FIG. 1, and FIG. 4 being a sectional view taken along the line A-A of FIG. 3.
Figure 2:
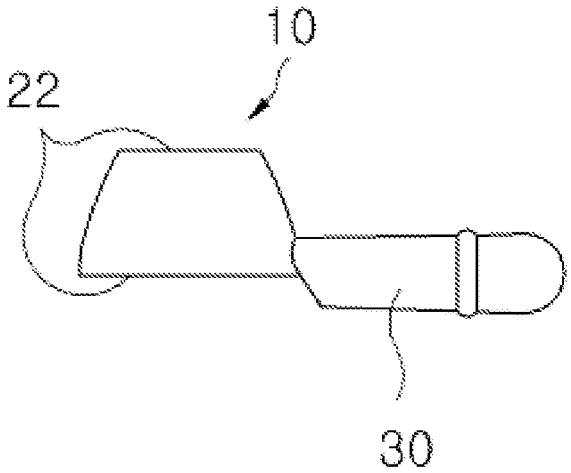
Figure 3:
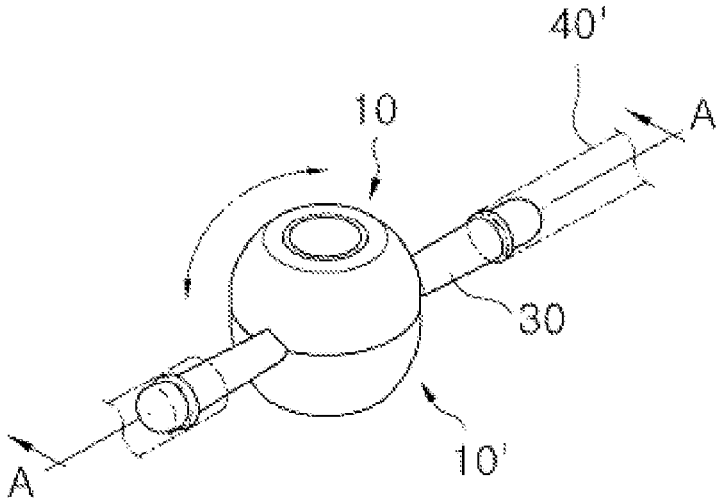
Figure 4:
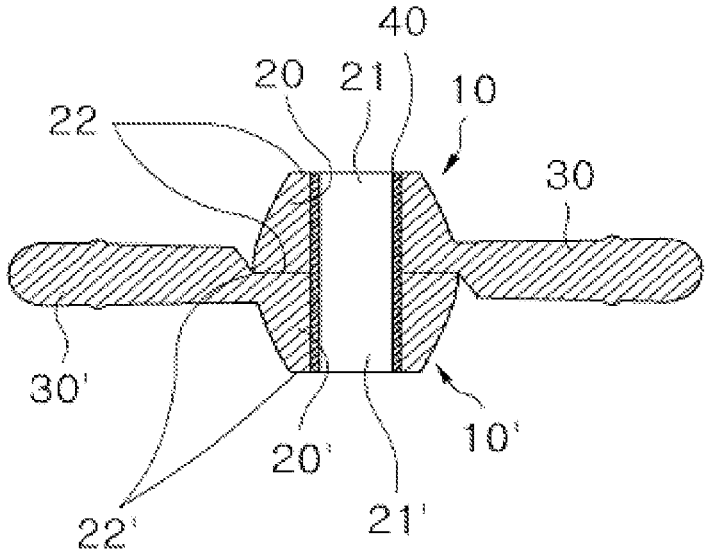
Figure 5:
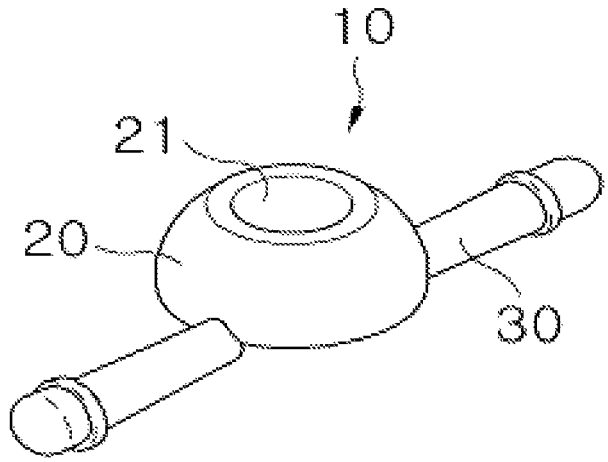
FIGS. 5~8 illustrates an alteration of the tube connector for an assembly toy according to the first embodiment of the present invention, FIG. 5 being a perspective view of the tube connector according to the alteration, FIG. 6 being a front view of FIG. 5, FIG. 7 being a perspective view illustrating a coupled state of two tube connectors of FIG. 5, and FIG. 8 being a sectional view taken along the line B-B of FIG. 7.
Figure 14:
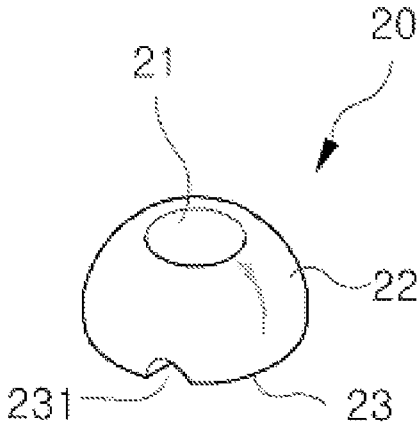
FIGS. 14~16 illustrates a tube connector for an assembly toy according to a third embodiment of the present invention, FIG. 14 being a perspective view of the tube connector according to the third embodiment, FIG. 15 being a side sectional view of FIG. 14, and FIG. 16 being a side view illustrating an alternately coupled state of two tube connectors of FIG. 14.
Figure 15:
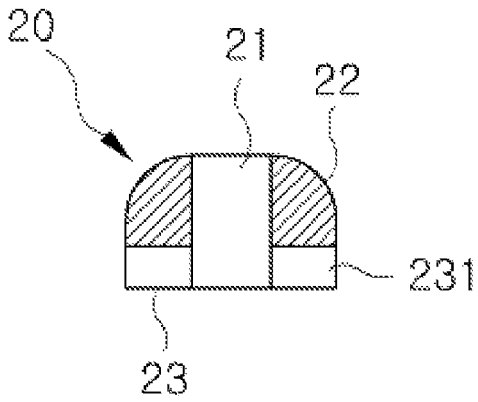
Figure 16:
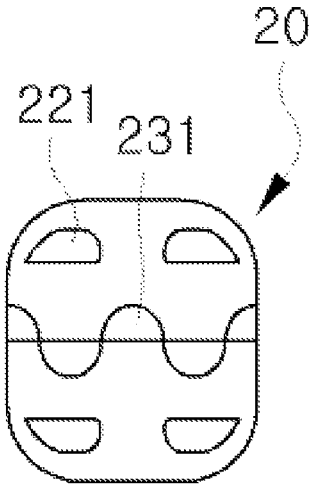
Figure 17:
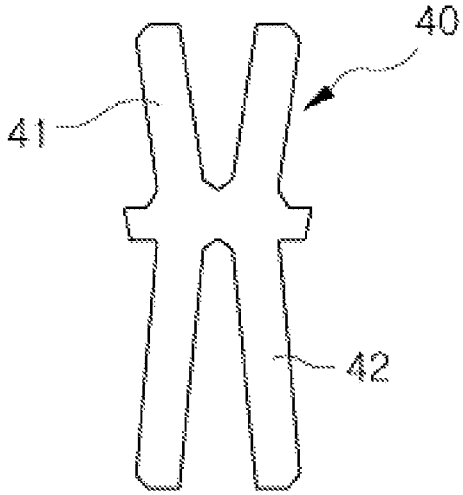
FIGS. 17~18 illustrates a tube connector coupling rib according to the present invention, FIG. 17 being a plan view of the coupling rib, and FIG. 18 being a perspective view of the coupling rib.
Figure 18:
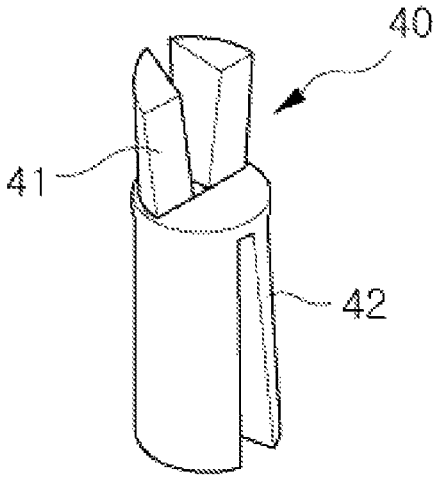
Figure 19:
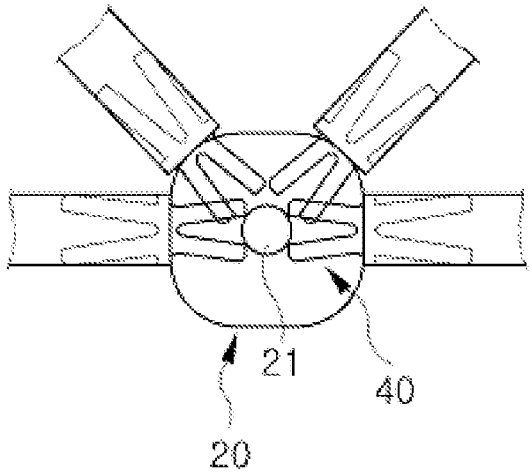
FIG. 19 is a view illustrating a state wherein the tube connector of FIGS. 14~16 is coupled with a plurality of the tube connector coupling ribs of FIGS. 17~18.
Figure 20:
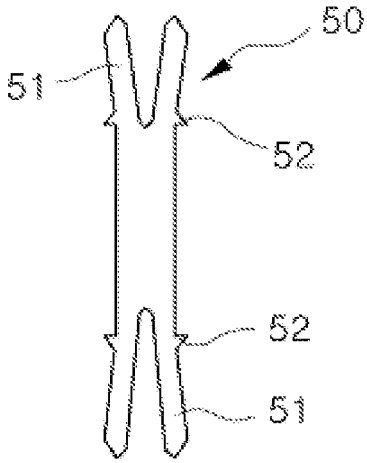
FIG. 20 is a plan view illustrating a tube connector coupling member according to the present invention.
Figure 21:
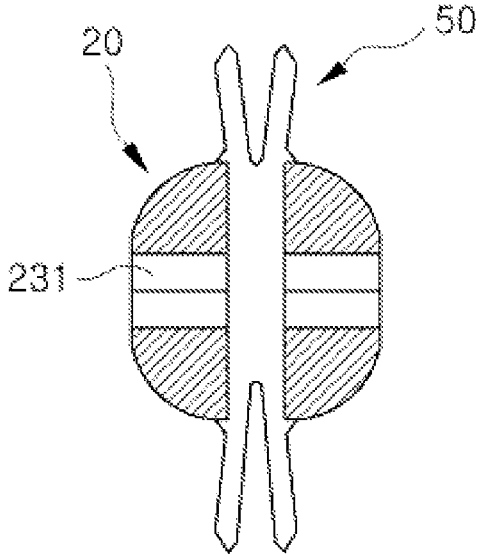
FIG. 21 is a view illustrating a state wherein the tube connector of FIGS. 14~16 is coupled with the tube connector coupling member of FIG. 20.

FIGS. 1~4 illustrates a tube connector for an assembly toy according to a first embodiment of the present invention, FIG. 1 being a perspective view of the tube connector according to the first embodiment, FIG. 2 being a front view of FIG. 1, FIG. 3 being a perspective view illustrating a coupled state of two tube connectors of FIG. 1, and FIG. 4 being a sectional view taken along the line A-A of FIG. 3. FIG. 5~8 illustrates an alteration of the tube connector for an assembly toy according to the first embodiment of the present invention, FIG. 5 being a perspective view of the tube connector according to the alteration, FIG. 6 being a front view of FIG. 5, FIG. 7 being a perspective view illustrating a coupled state of two tube connectors of FIG. 5, and FIG. 8 being a sectional view taken along the line B-B of FIG. 7. FIG. 9~13 illustrates a tube connector for an assembly toy according to a second embodiment of the present invention, FIG. 9 being a perspective view of the tube connector according to the second embodiment, FIG. 10 being a plan view of FIG. 9, FIG. 11 being a front view of FIG. 9, FIG. 12 being a perspective view illustrating a coupled state of two tube connectors of FIG. 9, and FIG. 13 being a sectional view taken along the line C-C of FIG. 12. FIG. 14~16 illustrates a tube connector for an assembly toy according to a third embodiment of the present invention, FIG. 14 being a perspective view of the tube connector according to the third embodiment, FIG. 15 being a side sectional view of FIG. 14, and FIG. 16 being a side view illustrating an alternately coupled state of two tube connectors of FIG. 14. FIG. 17~18 illustrates a tube connector coupling rib according to the present invention, FIG. 17 being a plan view of the coupling rib, and FIG. 18 being a perspective view of the coupling rib. FIG. 19 is a view illustrating a state wherein the tube connector of FIGS. 14~16 is coupled with a plurality of the tube connector coupling ribs of FIGS. 17~18, FIG. 20 is a plan view illustrating a tube connector coupling member according to the present invention, and FIG. 21 is a view illustrating a state wherein the tube connector of FIGS. 14~16 is coupled with the tube connector coupling member of FIG. 20.

Figure 6:
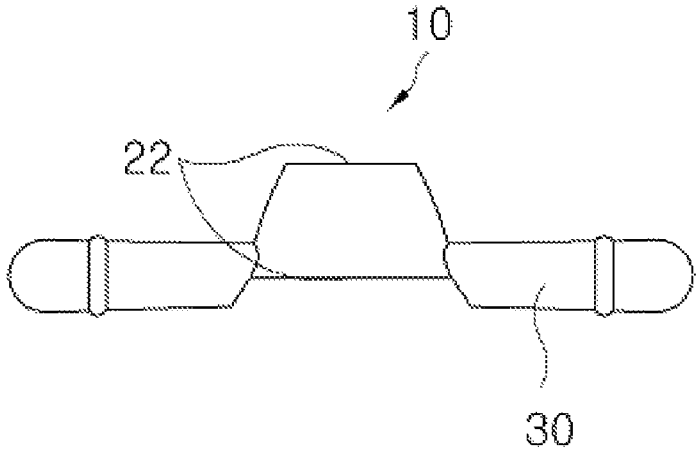
Figure 7:
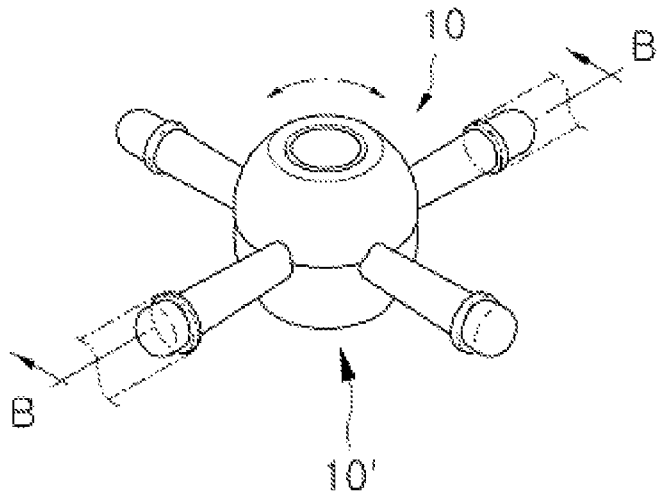
Figure 8:
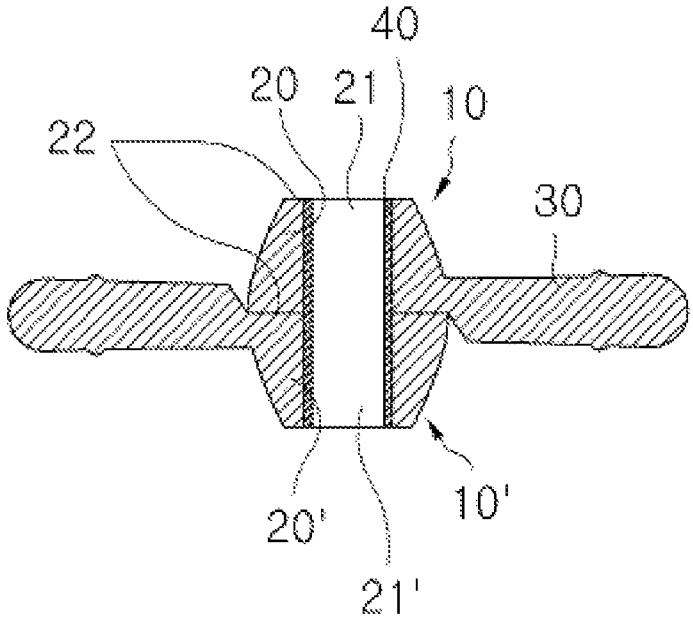
Figure 9:
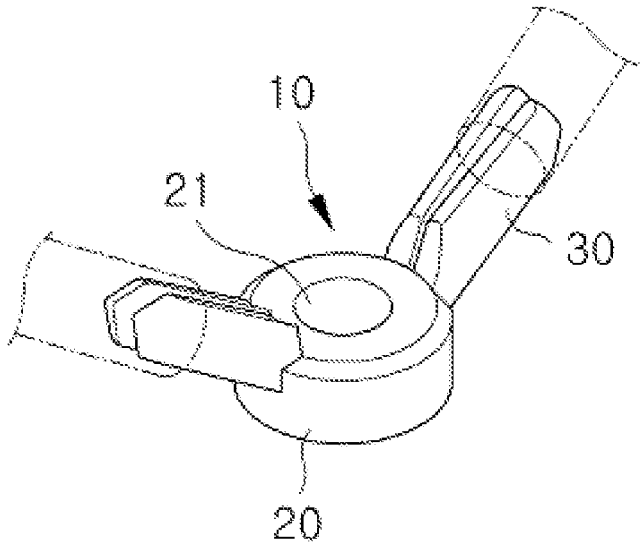
FIGS. 9~13 illustrates a tube connector for an assembly toy according to a second embodiment of the present invention, FIG. 9 being a perspective view of the tube connector according to the second embodiment, FIG. 10 being a plan view of FIG. 9, FIG. 11 being a front view of FIG. 9, FIG. 12 being a perspective view illustrating a coupled state of two tube connectors of FIG. 9, and FIG. 13 being a sectional view taken along the line C-C of FIG. 12.
Figure 10:
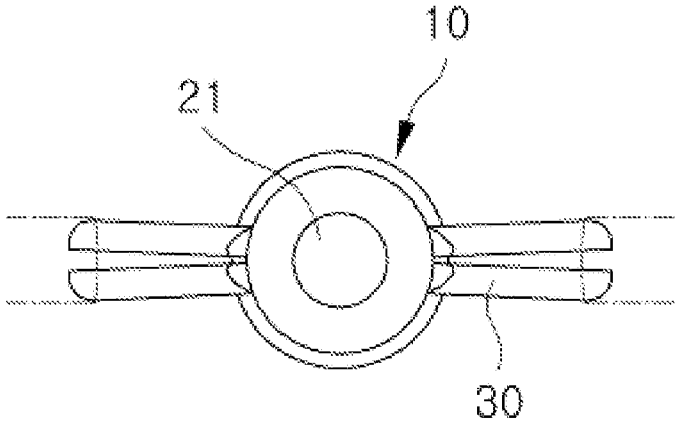

As shown in FIGS. 1~4 to 9~13, the tube connector 10 according to the first embodiment of the present invention includes a body 20 and at least one coupling rib 30, which are integrally formed with each other. The body 20 may have a semispherical shape as shown in FIGS. 1 and 2 and FIGS. 5 and 6, or may have a cylindrical shape as shown in FIGS. 9 and 10. The body 20 has horizontal surfaces 22 defined respectively at opposite upper and lower end surfaces thereof, and a circular hole 21 perforated in the center thereof, through which a tube 40' will be inserted perpendicular to the horizontal surfaces 22. The coupling rib 30 protrudes from an outer periphery of the body 20 at the level of any one of the horizontal surfaces 22, and takes the form of a bar. The bar-shaped coupling rib 30 is formed around an outer periphery thereof with a raised portion, to allow the coupling rib 30 to be firmly fixed in a tube by the raised portion when the coupling rib 30 is inserted into the tube. As shown in FIGS. 2 and 6, when the coupling rib 30 protrudes outward from the horizontal surface 22, a lower half portion of the coupling rib 30 corresponding to half the thickness of the coupling rib 30 protrudes downward from the horizontal surface 22. Although not shown in FIGS. 1~4 and 5~8, a distal end of the coupling rib 30 may be divided into two parts spaced apart from each other. In this case, the two spaced parts of the coupling rib 30 may press an inner wall of the tube connected to the coupling rib 30 by a restoration force thereof thus realizing strong fixation of the tube. In particular, when the distal end of the coupling rib 30 is divided into two V-shaped parts spaced apart from each other, fixation of different inner diameters of tubes may be possible based on a spacing distance of the two V-shaped parts. The coupling rib 30 may be arranged in the same horizontal direction as the horizontal surface 22, or may be tilted by a predetermined angle with respect to the horizontal surface 22.

As shown in FIGS. 3 and 4 and FIGS. 7 and 8, the tube connector 10 may be coupled with another tube connector 10' such that the horizontal surfaces 22 and 22' provided with the coupling ribs 30 and 30' are alternately coupled and come into contact with each other and such that the coupling ribs 30 and 30' of the respective tube connectors 10 and 10' protrude downward or upward from the horizontal surfaces 22 and 22' provided with the coupling ribs 30 and 30' by half the thickness of each coupling rib 30 or 30'. When the two tube connectors 10 and 10' are alternately coupled with each other, center axes of the respective coupling ribs 30 and 30' are aligned with the contact horizontal surfaces 22 and 22' of the two alternately coupled tube connectors 10 and 10'. As the tube 40' is inserted through the circular holes 21 perforated in the center of the respective bodies 20 and 20', the two tube connectors 10 and 10' are completely coupled with each other. Also, the two tube connectors 10 and 10' are rotatable clockwise or counterclockwise respectively on the basis of the horizontal surfaces 22 and 22' which come into contact with each other, thereby allowing tubes to be connected to the respective coupling ribs 30 and 30' at various angles.

The body 20 and the coupling rib 30 of the tube connector 10 may be integrally formed with each other by injection molding and may be made of, e.g. synthetic resins, such as plastic. As described above, the distal end of the coupling rib 30 may be divided into the two V-shaped parts spaced apart from each other, thereby allowing a tube to be inserted on the distal end of the coupling rib 30. Also, various diameters of tubes may be inserted on the coupling rib 30 based on a spacing distance of the two V-shaped parts.

Figure 11:
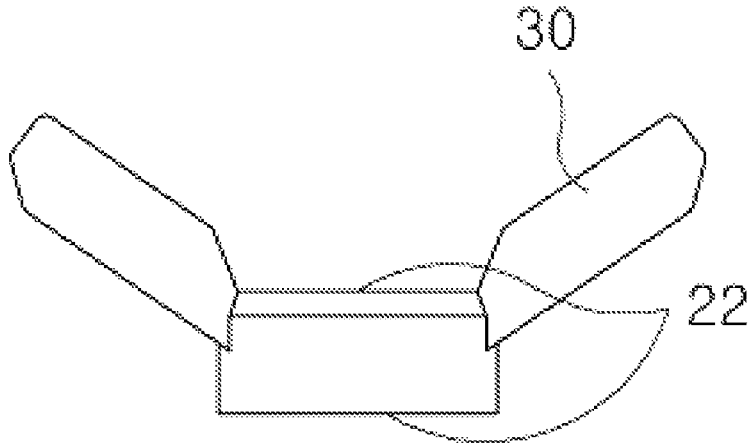
Figure 12:
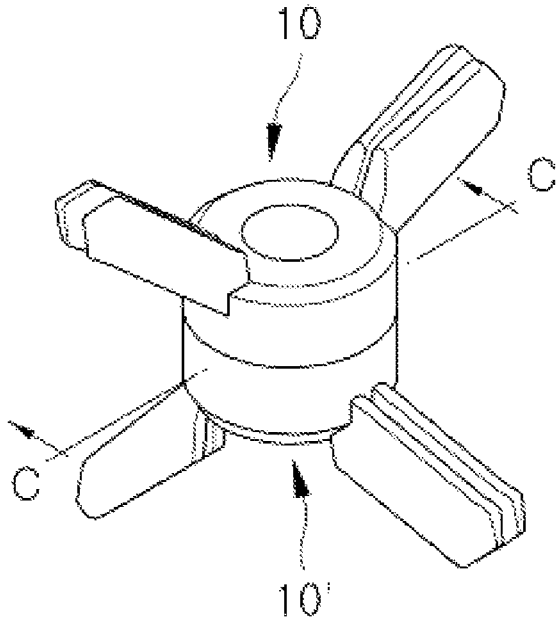
Figure 13:
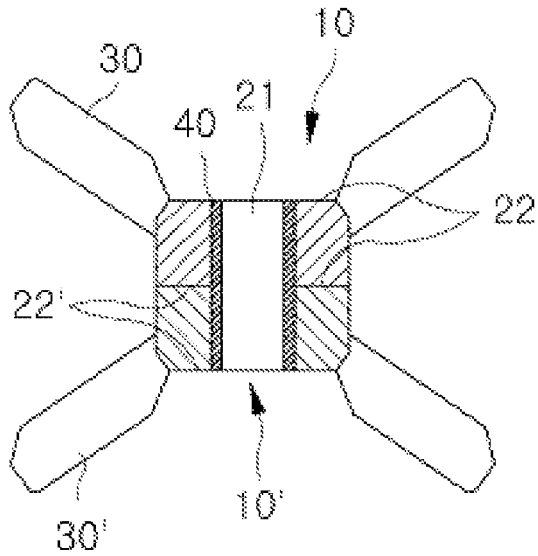

As shown in FIGS. 9~13, more particularly, FIGS. 9 to 11, the tube connector 10 according to the second embodiment of the present invention may include the cylindrical body 20 and the at least one coupling rib 30, which are integrally formed with each other. The body 20 has the horizontal surfaces 22 defined respectively at opposite upper and lower end surfaces thereof, and the circular hole 21 perforated in the center thereof, through which the tube 40' will be inserted perpendicular to the horizontal surfaces 22. The coupling rib 30 obliquely protrudes from the outer periphery of the body 20 at the level of any one of the horizontal surfaces 22. The distal end of the coupling rib 30 is divided into two parts spaced apart from each other, to allow the two spaced parts to press an inner wall of a tube connected to the coupling rib by a restoration force thereof thus realizing strong fixation of the tube. In particular, when the distal end of the coupling rib 30 is divided into two V-shaped parts spaced apart from each other, fixation of different inner diameters of tubes may be possible based on a spacing distance of the two V-shaped parts. As shown in FIGS. 12 and 13, the tube connector 10 may be coupled with another tube connector 10' that the facing horizontal surfaces 22 and 22' provided with the coupling ribs 30 and 30' are alternately coupled and come into contact with each other. As the tube 40' is inserted through the circular holes 21 perforated in the center of the respective bodies 20, the two tube connectors 10 and 10' are completely coupled with each other. Also, the two tube connectors 10 and 10' are rotatable clockwise or counterclockwise respectively on the basis of the horizontal surfaces 22 and 22' which come into contact with each other, thereby allowing tubes to be connected to the respective coupling ribs 30 at various angles. The body 20 and the coupling rib 30 of the tube connector 10 may be integrally formed with each other by injection molding and may be made of, e.g. synthetic resins, such as plastic.

Referring to FIGS. 14 to 16 illustrating the tube connector for an assembly toy according to a third embodiment of the present invention, the semispherical body 20 of the tube connector has a horizontal bottom surface 23, a cylindrical wall portion extending perpendicular from the bottom surface 23 up to a predetermined height, and a domed top portion 22 extending upward from the cylindrical wall portion.

The body 20 is centrally perforated with the circular or polygonal hole 21 perpendicular to the bottom surface 23, and the bottom surface 23 is formed with one or more insertion grooves 231 passing a center thereof. The domed top portion 22 of the body 20 is formed with a plurality of coupling holes 221. Thus, inserts 41 of several tube connector coupling ribs 40 which will be described hereinafter are inserted into the insertion grooves 231 and the coupling holes 221.

FIG. 16 illustrates an example of coupling the bodies 20 and 20' of the two tube connectors 10 and 10'. Once the bodies 20 and 20' of the tube connectors 10 and 10' come into contact with each other such that the insertion grooves 231 formed in the bottom surfaces 23 of the bodies 20 and 20' of the two tube connectors 10 and 10' are deviated from each other by predetermined angles, the inserts 41 of the coupling ribs 40 may be inserted into the respective insertion grooves 231 of the upper and lower bodies at different angles, thus providing various coupling angles of the coupling ribs 40.

As shown in FIGS. 17 and 18, the coupling rib 40 is formed at one end thereof with the insert 41, which is inserted into the insertion groove 231 or any one of the coupling holes 221, and at the other end thereof with a tube insert 42 to be inserted into a tube to be connected to the coupling rib 40. A distal end of each of the insert 41 and the tube insert 42 is divided into two parts spaced apart from each other, thus being inserted into the insertion groove 231, the coupling hole 221, or a tube connected to the coupling rib 40. The insertion groove 231 or the coupling hole 221 preferably has the same cross sectional shape as that of the insert 41 of the coupling rib 40. As the end of the coupling rib 40, i.e. the insert 41 is divided into the two parts spaced apart from each other, the insert 41 of the coupling rib 40 inserted into the insertion groove 231 or the coupling hole 221 may be elastically fixed therein. Similarly, the other end of the coupling rib 40, i.e. the tube insert 42 to be inserted into a tube connected to the coupling rib 40 is divided into two parts for strong fixation of the tube.

The domed top portion 22 of the body 20 has the plurality of coupling holes 221 for insertion of the inserts 41 of a plurality of the tube connector coupling ribs 40. The number of the coupling holes 221 may be determined within an allowable range sufficient to prevent interference between the neighboring coupling holes 221. Also, each of the coupling holes 221 has the same cross sectional shape as that of the insert 41.

FIG. 20 illustrates a tube connector coupling member 50, and FIG. 21 illustrates a state wherein the tube connector of FIGS. 14~16 is coupled with the tube connector coupling member of FIG. 20. The tube connector coupling member 50 of the present invention is formed at both ends thereof with coupling ribs 50. Once bottom surfaces of bodies 20 and 20' of the two tube connectors come into contact with each other, the tube connector coupling member 50 is inserted through the holes 21 perforated through the bodies 20 and 20' perpendicular to the bottom surfaces, thereby fixing the bodies 20 and 20' to each other without a risk of separation.

The tube connector coupling member 50 is formed at certain positions thereof with a pair of holding protrusions 52 with a predetermined interval. With this configuration, the two bodies 20 and 20' coupled with the coupling member 50 are seated between the pair of holding protrusions 52, to prevent the bodies 20 and 20' from being pushed toward one side of the tube connector coupling member 50. The tube connector coupling member 50 formed with the pair of coupling protrusions 52 is interference fitted through the holes 21 perforated in the bodies 20 and 20' such that the two bodies 20 and 20' are fixed between the pair of holding protrusions 52. After the tube connector coupling member 50 is integrally mounted to the bodies 20 and 20', a plurality of tubes may be coupled respectively to both the ends of the coupling member 50. Also, the coupling rib 40 may be mounted in each of the insertion grooves 231 defined in the horizontal contact surfaces of the bodies 20 and 20', for coupling of an additional tube.

Also, when the plurality of coupling ribs 40 is inserted into the respective insertion grooves 231, the coupling ribs 40 are positioned respectively at different upper or lower positions close to semispherical surfaces of the respective insertion grooves 231, thereby being fixed to the body at various angles without interference.

The coupling rib 40, as described above with reference to FIGS. 17 and 18, may include the tube connector insert 41 for coupling of the above-described tube connector, and the tube insert 42 for coupling of a tube. The tube connector 42 may have a circular cross section in consideration of coupling of a circular tube.

The tube connector insert 41 of the coupling rib 40, which will be inserted through the insertion groove 231 or the coupling hole 221, may have a semicircular cross section and correspondingly, the insertion groove 231 or the coupling hole 221 may have a semicircular cross section. If necessary, a plurality of the coupling holes 221 may be perforated in the body 20 for coupling of a plurality of the coupling ribs 40. The tube connector insert 41 provided at the end of the coupling rib 40 is divided into two parts spaced apart from each other, similar to the tube insert 42 provided at the other end of the coupling rib 40, thereby achieving strong fixation with the tube connector.

The tube connector of the present invention having the above-described configuration may allow a plurality of coupling ribs for coupling and fixation of tubes to be arranged at various angles. Also, when two tube connectors are alternately coupled with each other, the coupling ribs coupled to the tube connectors may be rotatable in the same plane.

As apparent from the above description, the present invention provides a tube connector for an assembly toy, which includes a center body and a coupling rib protruding outward from the body while defining a stepped portion along with the body. With this configuration, when the tube connector is alternately coupled with another tube connector, the two tube connectors come into partial contact with each other based on the stepped portions such that the coupling ribs of the two tube connectors are arranged on the same plane.

The body is formed in a horizontal bottom surface thereof with a plurality of insertion grooves. One end of the coupling rib, which defines a tube connector insert to be inserted into the insertion groove of the body, is divided into two parts spaced apart from each other. This has the effect of reducing the size of the insertion groove defined in the body and providing the body with a greater number of insertion grooves, resulting in tube connection at various angles.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An assembly unit for an assembly toy, the assembly unit comprising a first tube connector and a second tube connector, each of the tube connectors comprising:

a semispherical or cylindrical body having a horizontal surface;

a hole perforated through the center of the body perpendicular to the horizontal surface, and at least one coupling rib outwardly extending from an outer surface of the body, wherein the at least one coupling is configured to allow a tube to be inserted thereon, wherein the first tube connector is coupled with the second tube connector such that the horizontal surface of the first tube connector and the horizontal surface of the second tube connector are alternately coupled and come into contact with each other, and wherein the horizontal surface of the first tube connector is rotatable clockwise or counterclockwise with respect to the horizontal surface of the second tube connector, wherein during rotation, the horizontal surface of the first tube connector is in contact with the horizontal surface of the second tube connector.

2. The assembly unit according to claim 1, wherein an end of the at least one coupling rib is divided into two parts spaced apart from each other to enable an elastic fixation of the tube by an insertion of the two spaced parts of the at least one coupling rib into the tube.

3. The assembly unit according to claim 1, wherein the coupling rib extends in a parallel direction to a plane defined by the horizontal surface.

4. The assembly unit according to claim 1, wherein the at least one coupling rib obliquely extends from the body at a predetermined angle with respect to the horizontal surface.

5. The assembly unit according to claim 1, wherein the hole has a circular cross section, and the tube is inserted through the holes of the first and second tube connectors for inter-coupling the first and second tube connectors.

6. The assembly unit according to claim 1, wherein the at least one coupling rib is integrally formed with the body.

7. The assembly unit according to claim 1, wherein the at least one coupling rib has a circular bar-shape.

8. The assembly unit according to claim 1, wherein the at least one coupling rib has a raised portion located on an outer periphery thereof and configured to fix the inserted tube.

9. The assembly unit according to claim 1, wherein a lower half portion of the at least one coupling rib protrudes downward from the horizontal surface and extends away from the body.

10. The assembly unit according to claim 1, wherein the at least one coupling rib is disposed at the level of the horizontal surface, and a center axis of the at least one coupling rib is aligned with the horizontal surface.

11. The assembly unit according to claim 1, wherein the body has a plurality of coupling holes configured to receive the at least one coupling rib.

12. The assembly unit according to claim 1, wherein the surface has a plurality of insertion grooves configured to receive the at least one coupling rib.

13. The assembly unit according to claim 1, wherein the at least one coupling rib is elastically coupled to the body.

14. The assembly unit according to claim 1, further comprising a tube connector coupling member having a pair of coupling protrusions, wherein the tube connector coupling member is disposed in the holes of the first and second tube connectors to fix the first and second tube connectors to one another.

* * * * *